US006784898B2

(12) United States Patent
Lee et al.

(10) Patent No.: US 6,784,898 B2
(45) Date of Patent: Aug. 31, 2004

(54) MIXED MODE GRAYSCALE METHOD FOR DISPLAY SYSTEM

(75) Inventors: Sangrok Lee, Durham, NC (US); Kristina M. Johnson, Durham, NC (US)

(73) Assignee: Duke University, Durham, NC (US)

( * ) Notice: Subject to any disclaimer, the term of this patent is extended or adjusted under 35 U.S.C. 154(b) by 0 days.

(21) Appl. No.: 10/289,463

(22) Filed: Nov. 7, 2002

(65) Prior Publication Data

US 2004/0090446 A1 May 13, 2004

(51) Int. Cl.[7] ..... G09G 5/10
(52) U.S. Cl. ..... 345/692; 345/690; 345/89
(58) Field of Search ..... 345/690–693, 345/89, 77, 63

(56) References Cited

U.S. PATENT DOCUMENTS 5,798,743 A 8/1998 Bloom
5,818,419 A * 10/1998 Tajima et al. ..... 345/691
6,072,448 A * 6/2000 Kojima et al. ..... 345/63
6,097,368 A * 8/2000 Zhu et al. ..... 345/601
6,151,001 A 11/2000 Anderson et al.
6,396,508 B1 5/2002 Noecker ..... 345/693
6,529,204 B1 * 3/2003 Mikoshiba et al. ..... 345/597
2003/0006952 A1 * 1/2003 Hong ..... 345/89

* cited by examiner

*Primary Examiner*—Bipin Shalwala
*Assistant Examiner*—Ricardo Osorio
(74) *Attorney, Agent, or Firm*—Fleshner & Kim, LLP

(57) ABSTRACT

A method for generating a grayscale representation for a display combines analog and digital techniques to produce images of optimal quality. The grayscale representation is not limited by frame frequency compared to digital techniques and not limited by small voltage differences between pixel electrodes. In the method, a frame is first divided into sub-frames of most significant bits and least significant bits. The sub-frame time can either be weighted or uniform. An analog voltage is then applied to the sub-frames to produce a reduced grayscale. The number of sub-frames and the brightness are two parameters that can be optimized for a best possible display result.

24 Claims, 11 Drawing Sheets

$$16/7 \times 15 + 1/17 \times 15 = 255/17$$
$$= 15$$
$$= 100\%$$

Mixed Method of Grayscale Representation (Analog Grayscale Representation)

Grayscale Representation

5-BIT Grayscale Representation

| SUBFRAME TIME | | | | |
|---|---|---|---|---|
| WEIGHT | $2^3$ | $2^2$ | $2^1$ | 1 |
| ILLUMINATION | 1 | 1/2 | 1/4 | 1/8 |

1 x 1/4 + 1/2 x 1/4 + 1/4 x 1/4 + 1/8 x 1/4 = 15/32 = 50%

4-BIT Greyscale Representation
with Weighted Illumination

FIG. 4

RELATED ART

| SUBFRAME TIME | | | | |
|---|---|---|---|---|
| WEIGHT | $2^3$ | $2^2$ | 2 | 1 |
| ILLUMINATION | 1 | 1 | 1 | 1 |

8/15 + 4/15 + 2/15 + 1/15 = 15/15 = 100%

1 x 1/4 + 1/2 x 1/4 + 1/4 x 1/4 + 1/8 x 1/4 = 15/32 = 50%

4-bit Grayscale Representation
with Uniform Illumination

FIG. 5

RELATED ART

The Architecture of a Mixed Mode Driver Chip

Mixed grayscale method with two panels

| | | |
|---|---|---|
| SUB-FRAME TIME | 16 | 1 |
| ILLUMINATION | 1 | 1 |

$$16/7 \times 15 + 1/17 \times 15 = 255/17$$
$$= 15$$
$$= 100\%$$

Mixed Method of Grayscale Representation

UNIFORM SUB-FRAME TIME

N = 0

| | SF1 | SF2 |
|---|---|---|
| SUB-FRAME TIME | 16 | 1 |
| ILLUMINATION | 1 | 1/16 |

1/2 x 15 (GRAY SCALE) + 1/2 x 1/16 x 15
= 255/32 = 8 = 50%

A Mixed Greyscale Representation with 2 Sub-Frames

FIG. 9

UNIFORM SUB-FRAME TIME

N = 2

| | SF1 | SF2 | SF3 | SF4 | SF5 |
|---|---|---|---|---|---|
| SUB-FRAME TIME | 4 | 4 | 4 | 4 | 1 |
| ILLUMINATION | 1 | 1 | 1 | 1 | 1/4 |

4/5 x 15 (Grayscale) + 1/5 x 1/4 x 15
= 255/20 = 12.75 = 85%

Mixed Greyscale Representation with 5 Sub-Frames

FIG. 10

1-Panel Projection Display with Field Sequential Color

2-Panel Projection Display with Partial Field Sequential Color

MIXED MODE GRAYSCALE METHOD FOR DISPLAY SYSTEM

BACKGROUND OF THE INVENTION

1. Field of the Invention

This invention relates to the field of grayscale representation for displays. More particularly, the present invention relates to a system and method for generating a mixed grayscale representation by presenting reduced analog gray level in multiple digital sub-frames.

2. Background of the Related Art

Conventional grayscale representations for a liquid crystal display (LCD) are generated either by an analog method that applies voltages between pixels or a digital method that adopts a time multiplexed grayscale.

Referring to FIG. 1, in the analog method, grayscale level can be generated on a screen of an analog display by varying a data voltage to modulate the brightness of each pixel. Nowadays, most displays require a grayscale of more than 8 bits per color and an operating voltage low enough to be powered by battery. This makes the voltage difference between consecutive gray levels extremely small such that the voltage difference becomes comparable to or less than the offset voltage of an analog buffer or a D/A converter used for analog signal processing, making the representation of grayscale from each D/A converter inconsistent.

Referring to FIG. 2, the digital method adopts time multiplexed grayscale in which a frame, i.e., a pixel cycle, is divided into many sub-frames, i.e., equal duration time slots. Each frame is driven ON or OFF individually. The pixel can be activated during any number of the sub-frames and the gray level is determined by the number of sub-frames which turn on. For example, the same gray level will be achieved where four sub-frames are activated whether the first four, last four or alternating sub-frames are activated.

The digital representation can be implemented in several ways by varying the sub-frame time and light intensity associated with each frame. In FIG. 3, a uniform sub-frame time and uniform illumination scheme is disclosed. The gray level represented by this method is limited by the frame-update time and liquid crystal switching time since same data is written many times to represent one bit. Generally, it is difficult to express gray level using more than 5 bits, which already require an update frequency of 5760 Hz to represent 60 images in three primary colors, red, green, and blue, as shown in Equation 1.

$$60(\text{no. of images})\times 32(2^5\ \text{sub-frames})\times 3(R,G,B)=5760\ \text{Hz} \quad (1)$$

In another gray level representation scheme disclosed by FIG. 3, each sub-frame has weighted frame time according to the bit weight. The number of sub-frames is significantly reduced, therefore, removing the limit of updating frequency. It seems possible to represent 8 bit gray level if only updating frequency is considered. However, the shortest frame time is also limited by the frame-update time and liquid switch time as the sub-frame time disclosed by the previous scheme. Nevertheless, the update frequency required to represent 60 images with 5 bits is reduced to 900 Hz, as shown in Equation 2.

$$60(\text{no. of images})\times 5(5\ \text{sub-frames})\times 3(R,G,B)=900\ \text{Hz} \quad (2)$$

Unfortunately, this method may cause flicker since the data of the least significant bit is switched on and off in the blink of an eye and requires more complex control circuit than the uniform sub-frame time and uniform illumination scheme due to weighted frame time.

In FIG. 4, a uniform sub-frame time with weighted illumination scheme is disclosed. The sub-frame time used in this scheme is divided uniformly with weighted illumination of the light source according to the bit weight. This method reduces the complexity of control circuit and the number of sub-frames to display, e.g., it requires only 5 times of scanning for 5 bit gray level display and 900 Hz update frequency to represent 60 images, as shown in Equation 3.

$$60(\text{no. of images})\times 4(4\ \text{sub-frames})\times 3(R,G,B)=900\ \text{Hz} \quad (3)$$

However, this scheme has a loss of brightness as compared to a display with weighted sub-frame time and uniform illumination. For example, when all bits of 4 bit data are "1", the brightness of the brightest level is calculated from the sum of brightness of each frame, where the brightness of a sub-frame is expressed by frame time times illumination. The brightest level of this method is given by $$1\times\tfrac{1}{4}+\tfrac{1}{2}\times\tfrac{1}{4}+\tfrac{1}{4}\times\tfrac{1}{4}+\tfrac{1}{8}\times\tfrac{1}{4}=\tfrac{15}{32}\cong 50\%$$

where the brightest level of the scheme with weighted frame time is given by $$\tfrac{8}{15}+\tfrac{4}{15}+\tfrac{2}{15}+\tfrac{1}{15}=\tfrac{15}{15}=1=100\%$$

As shown in FIG. 5, the brightness is almost twice of the brightness of a weighted illumination display depicted in FIG. 5. Thus, a mixed method taking advantage of both analog and digital methods is needed to decrease flicker and lower update frequency without sacrificing brightness and without complicating the control circuit.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

An object of the present invention is to provide a mixed grayscale representation that takes advantage of both the analog and digital methods by representing reduced analog gray scale levels in multiple digital sub-frames. Grayscale representation can be implemented with this mixed method without the frame frequency limitation of a digital method and the small voltage difference ($\Delta V$) limitation of an analog method.

For a $2^D$ bit gray level implementation of the present invention, a frame can be divided into $2^N$, where N=1, 2, . . . , D−1. The maximum number of sub-frames is determined by D−1, where $2^D$ is the number of the data bit. In an 8 bit gray level a frame can be divided into 2 sub-frames or 4 sub-frames, the sub-frame time can be either weighted or uniform. When a frame is divided into 2 sub-frames, the first sub-frame is used to display upper 4 bit data and the second sub-frame is used to display lower 4 bit data. Each 4 bit data can then be expressed in an analog manner by applying control voltages to pixel electrodes. When a frame is divided into 4 sub-frames, each sub-frame is used to display 2 bit data. Before applying the analog voltage, the voltage difference, $\Delta V$, between two consecutive gray levels is first determined by dividing the upper and lower voltage limits, Vpp, with the number of gray levels, G, thereby specifying the display quality for the system, i.e., $\Delta V = Vpp/G$. Then, the voltage corresponding to a certain gray level stated as $V = \Delta V \times G$ is then applied to the electrodes for a whole frame to represent the desired grayscale.

In an alternative embodiment of the invention, a weighted sub-frame time can be implemented. The shortest sub-frame time in the weighted sub-frame time approach is not as short as that of a conventional digital method. An additional control circuit is used to produce weighted frame time in accordance with the weight of the 4 bit data.

In yet another embodiment of the invention, a uniform sub-frame time can be implemented. The control circuit for this embodiment can be greatly simplified with a reduction of overall brightness. Further, by making the number of sub-frames is selected to be $2^N+1$, $N>1$, the brightness reduction can also be eliminated. Thus, by optimizing the these parameters, namely, the number of sub-frames and brightness, the display can be optimized. In general, the shorter sub-frame time requires a lower capacitance of memory and have a smaller liquid crystal pixel to hold the stored charge.

In yet another embodiment of the invention, two-panel display can be implemented. The first panel is used to display upper 4 bits and the second panel is used to display lower 4 bits. The intensity of light modulated by each panel is controlled by the retarder such that the intensity provided for the first panel is brighter than the intensity for the second panel by 16 times. By replacing the two temporal sub-frames used in the previous implementations with two independent panels, this implementation has reduced total frame frequency by half, allowing more flexibility in switching time of the liquid crystals.

This mixed grayscale representation method with above described advantages can be applied in most major displays that use active driving, such as TFT LCDs, liquid crystal on silicone (LCOS), electro luminescence (EL) display, plasma display panels (PDPs), field emission displays (FEDs), field sequential color display, projection displays and direct view display, such as head mounted displays (HMDs). This technique can also be used in LCOS beam deflector, phased-array beam deflector, and is especially effective in reflective displays that adopt silicon substrate backplanes.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIG. 4 shows a diagram illustrating a 4-bit grayscale representation with uniform sub-frame time and weighted illumination in the related art.

FIG. 5 shows a diagram illustrating a 4-bit grayscale representation with uniform sub-frame time and uniform illumination in the related art.

FIG. 9 shows a diagram illustrating the mixed method of grayscale representation according to one embodiment of the present invention.

FIG. 10 shows a diagram illustrating the mixed method of grayscale representation according to another embodiment of the present invention.

DETAILED DESCRIPTION OF PREFERRED EMBODIMENTS

Figure 1:
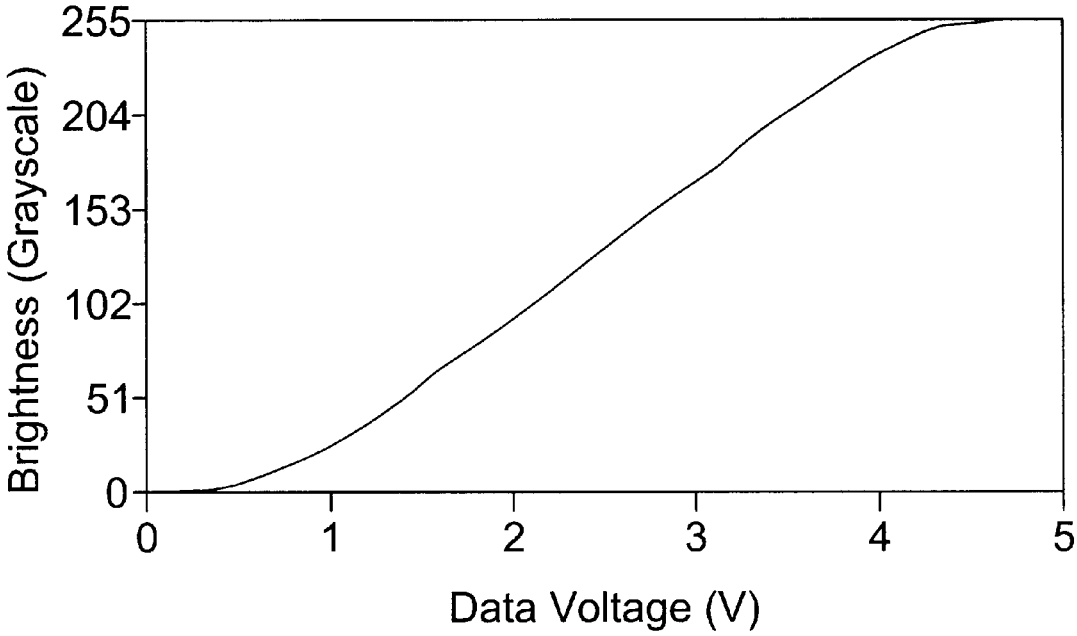
FIG. 1 RELATED ART
FIG. 1 shows a graphical diagram illustrating the analog grayscale representation of a liquid crystal display (LCD) in the related art.
Figure 2:
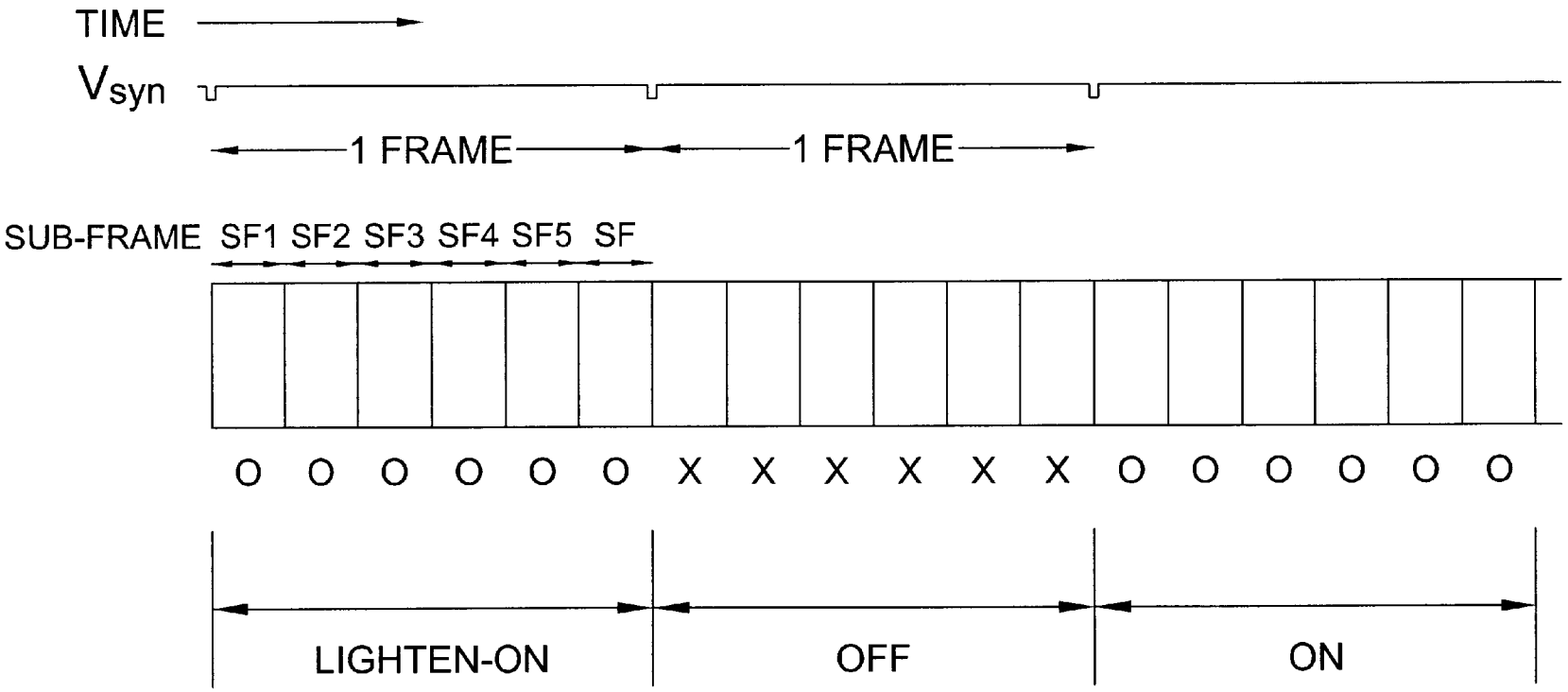
FIG. 2 RELATED ART
FIG. 2 shows a diagram illustrating a general structure of a grayscale representation in the related art.
Figure 3:
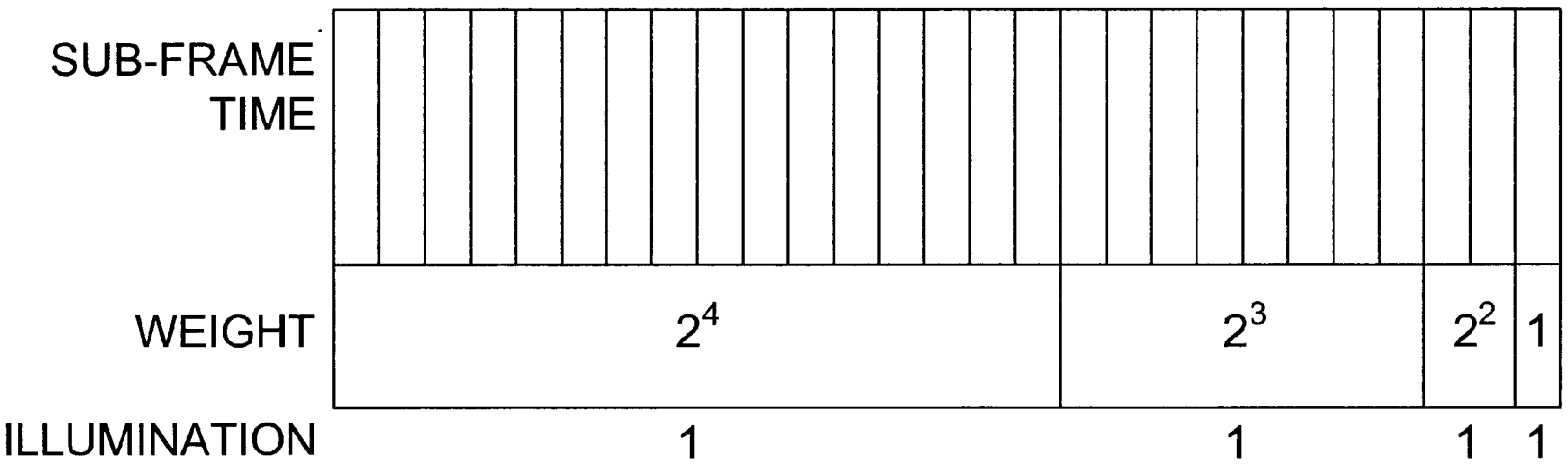
FIG. 3 RELATED ART
FIG. 3 shows a diagram illustrating a 5-bit grayscale representation with weighted sub-frame time and uniform illumination in the related art.
Figure 6:
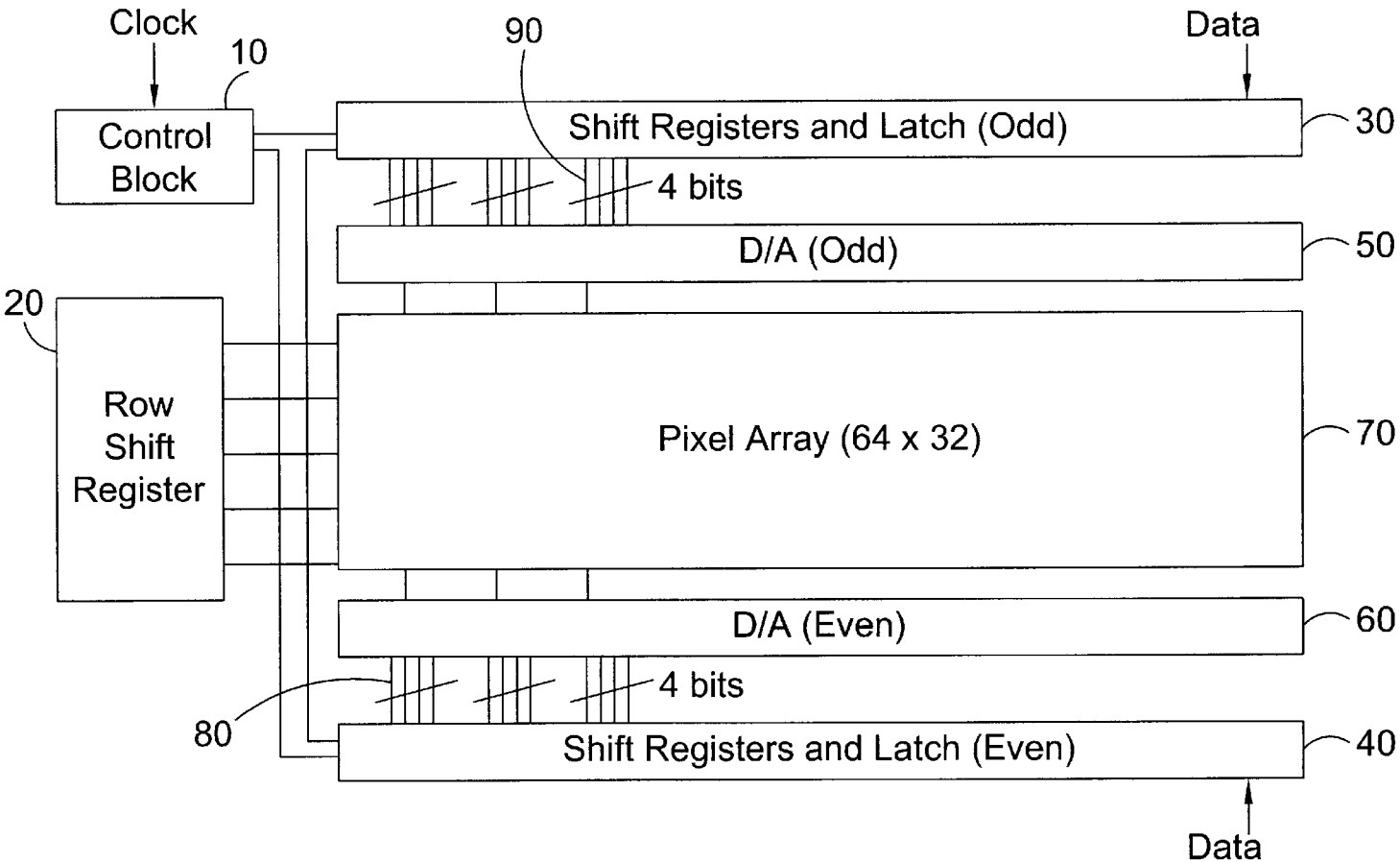
FIG. 6 shows a diagram illustrating the architecture of a mixed mode driver chip utilizing the present invention.

FIG. 6 is an exemplary diagram illustrating a general architecture of a driver chip utilizing a mixed grayscale representation according to one embodiment of the present invention. A control block 10 controls display on a pixel array display panel 70. A row shift register 20 is provided for the scanning signal for rows of pixels in the display panel. A divider (not shown) divides data into the most significant bit (MSB) and the least significant bit (LSB). These sub-frame data are fed to a shift register and latch (odd) 30 and a shift register and latch (even) 40. The shift register and latch (odd) 30 preferably shifts serial four bit data to make parallel four bit data and hold the data. A digital to analog (D/A) converter 50 converts the parallel four bit data into analog signals for an odd number of columns of pixels. A parallel four bit sub-frame data 90 is generated from the shift register and latch (odd) 30 and is converted to the analog signals by the digital to analog converter (odd) 50, and then the analog signal outputs to pixel array 70. A shift register and latch (even) 40 is provided to shift and latch the sub-frame data, and a digital to analog (D/A) converter 60 converts the sub-frame data into analog signals for an even number of columns of pixels. A parallel four bit sub-frame data 80 is generated from the shift registers and latch (even) 40 and is converted to the analog signals by the digital to analog converter (even) 60, and then the analog signal outputs to the pixel array 70.

The control block 10 preferably first generates control signals of scanning, write, and read to the row shift register 20, shift registers and latch (odd) 30 and shift registers and latch (even) 40. A separate controller (not shown) is also provided for determining the illumination intensity of each sub-frame. The scanning signal controls the scanning performed by the row shift register 20 to the pixel array 70 during each clock period. Data in this exemplary diagram are divided into two sub-frames, which are required to display an image with the mixed grayscale representation approach. Each of these two sub-frames preferably contains 4 bits. The write and read signals received at the shift registers and latch (odd) 30 and shift register and latch (even) 40 control the data process of the odd number columns of pixels and even number of columns of pixels, respectively. The sub-frame data are converted into analog signals at the digital to analog converter (odd) 50 and digital to analog converter (even) 60, and subsequently output to the pixel array 70. The write and read control signals turn on and off the pixels in the pixel array 70 according to the mixed grayscale representation scheme of the preferred embodiment. Frame buffer pixels are one good example of the present invention. However, the utilization of the present invention is not limited to frame buffer pixel display only.

An additional data controller or data processor may be used to process the data according to a chosen parameter N. That is, a parameter selection circuit may be used to select parameter N. The process will extract and send upper four bits and lower four bits in sequence for 2 sub-frame implementation. However, the process will extract upper four bits and send $2^N$ times to the display and extract lower four bits and send them to the display once.

Figure 7:
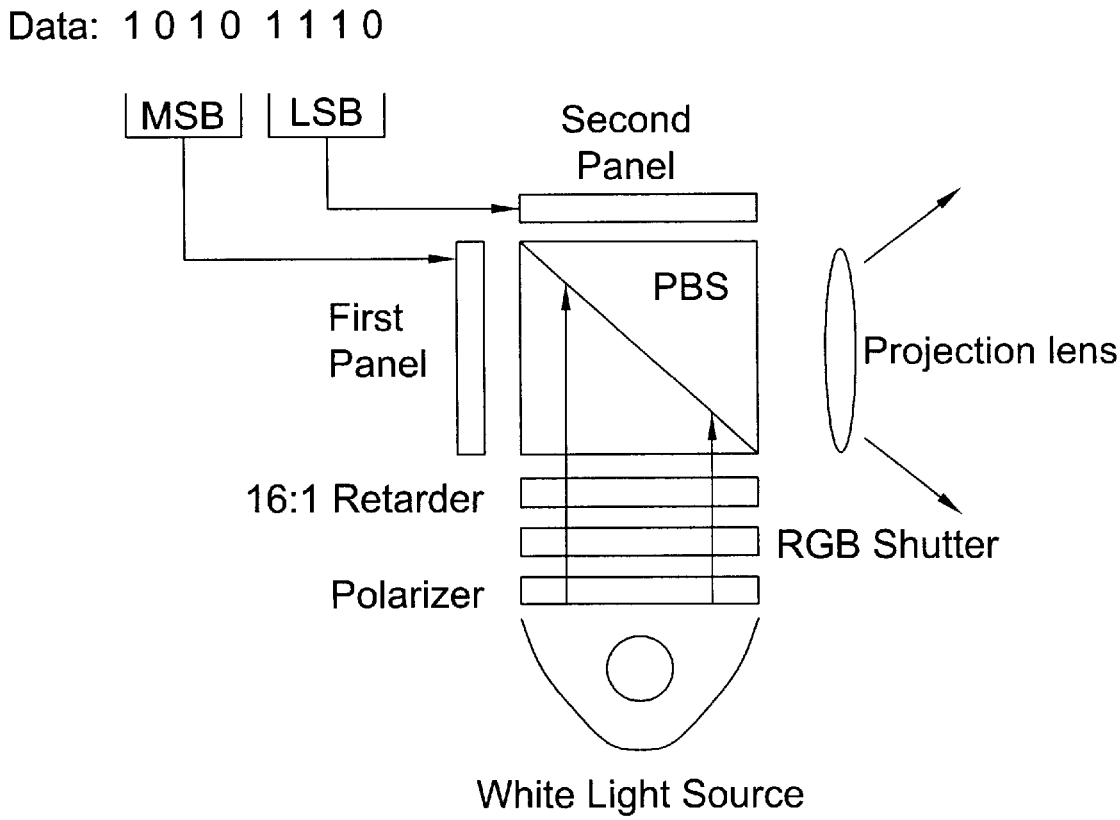
FIG. 7 shows a diagram illustrating a 4-bit grayscale representation with two-panels in the related art.

FIG. 7 shows another embodiment of the invention which includes a two-panel display implemented using the mixed method of gray level representation. In this embodiment, eight data bits are divided into two sub-frames. The upper 4 bits are most significant bits (MSBs) and the lower 4 bits are least significant bits (LSBs). The first panel may be used to display the MSBs and the second panel may be used to display the LSBs. The intensity of light modulated by each panel is preferably controlled by a 16:1 retarder, together with a polarizer and RGB shutter, With this arrangement, the intensity provided for the first panel may be brighter than the intensity for the second panel by 16 times. By replacing the two temporal sub-frames used in the previous implementations with two independent panels, this implementation reduces the total frame frequency by half, allowing more flexibility in switching time of the liquid crystals.

Figure 8:
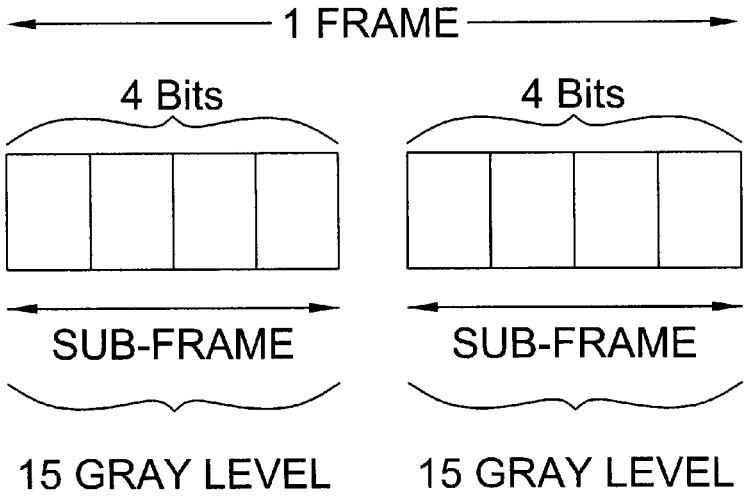
FIG. 8 shows a diagram illustrating the mixed method of grayscale representation according to a preferred embodiment of the present invention.

FIGS. 8–10 illustrate an implementation of the mixed grayscale representation method according to a preferred embodiment of the present invention. This mixed grayscale representation takes advantage of the analog and digital methods. In a display panel with frame buffer pixels, a pixel cycle, commonly known as a frame, is preferably divided into equal duration time slots, or sub-frames. The pixel can be activated during any number of these sub-frames. The sub-frame time could be weighted or uniform. The total intensity of the pixel, i.e., grayscale, is dependent upon the duration of a certain intensity that the pixel holds. The mixed grayscale representation of the preferred embodiment is able to represent reduced analog gray levels in multiple digital sub-frames without the frame frequency limitation of the digital method and the small voltage difference (ΔV) limitation of the analog method. A small ΔV is generally required when a battery is used as a power source for portable display devices, such as laptop computers and personal digital assistants (PDA). There are many ways of dividing one frame into sub-frames. In the preferred embodiment, one frame is divided into a least significant bit (LSB) and a most significant bit (MSB). Data bits can be divided into three or four sections, i.e., three or four sub-frames. Two sections is the preferred method when 8-bit data is considered. In general, a frame can be divided up to N/2 sections where N is the total number of data bits. In FIG. 8, an exemplary diagram shows a mixed grayscale method with weighted sub-frame time and uniform illumination. An 8-bit frame is divided into two sub-frames. The first sub-frame is used to display the upper 4 bit data and the second sub-frame displays the lower 4 bit data. Each 4 bit data can then be expressed in an analog method that applies analog voltage to the pixel electrodes.

The amount of the light transmitted or reflected from liquid crystal media is proportional to the voltage level applied between two electrodes. In applying the analog voltage, first the voltage difference, ΔV, between two consecutive gray levels is determined. This is preferably done by dividing the upper and lower voltage limits applied between two electrodes, Vpp, with the number of gray levels, G, which specify the display quality for the system, as shown in Equation 4.

$$\Delta V = Vpp/G \tag{4}$$

While Vpp has been described as corresponding to a maximum voltage range applied between two electrodes, the present invention may implemented using a different Vpp. For example, if desired Vpp may correspond to an offset voltage applied to the electrodes based on LC modes.

After ΔV has bee determined, the applied voltage corresponding to a certain gray level, stated as $V=\Delta V \times G$ is applied to the electrodes for each sub-frame to represent the desired grayscale. For example, in an 8 bit mixed grayscale representation where the maximum voltage range applied $V_{pp}$=3.3 V, ΔV=3.3/15=220 mV. That is, to represent a grayscale of 15 by way of the mixed method of the preferred embodiment, a voltage of 3.3 V needs to be applied to the electrodes of each sub-frame to achieve a desired grayscale level of 15. The 220 mVvoltage difference between two electrodes provides a smooth changing of the light reflection in liquid crystal media. Since the light intensity of liquid crystal media is non-linearly dependent on the applied voltage, the ΔV is not usually constant in all ranges. Gamma correction circuit is required to generate ΔV in all ranges to express exact amount of the light intensity according to the gray level.

In this mixed method, the shortest sub-frame time of a weighted sub-frame method is not as small as that of the conventional digital weighted frame according to the weight of 4 bit data. That is, the smallest sub-frame time of the mixed method has weight of 16 since it displays 16 gray levels while the smallest sub-frame time of conventional digital method has the weight of one because it displays either "on" or "off". When N is equal to half of the data bit, the method becomes very close to the weighted sub-frame method with uniform illumination.

In general, the shorter sub-frame time needs smaller capacitance of memory, which is proportional to the area of dielectric on the silicon, and liquid crystal pixels to hold the charge stored during the write cycle activated by a write signal. Thus, the shorter sub-frame time further reduces the manufacturing cost because the area on the silicon is sharply affecting the manufacturing cost. The cost of optics, such as polarizing beam splitter, lens, and shutter, used to guide light to and from the panel is almost exponentially dependent on the panel size. The smaller pixel size can make smaller panel as far as the resolution of the panel is kept constant. Moreover, the effect is cumulative. For example, a 5 um decrease in pixel size yields 5 um * number of column or row decrease in the entire panel. However, smaller pixels require faster electronics to speed up the signal processing.

An additional control circuit is also needed to produce weighted frame times according to the weight of 4 bit data. If the uniform sub-frame time scheme is selected, the control circuit can be simplified, but this comes with a loss of overall brightness. The loss of brightness mainly results from the attenuated intensity illuminated during the sub-frame for lower 4-bit data. The loss can be reduced if the number of sub-frames is made to be $2^N+1$, N>1. There is a trade off between the number of sub-frames and brightness loss. That is, the two parameters, sub-frame number and brightness, can be optimized to achieve the best display result. For example, when N=0, the brightness loss is about 50% of the weighted sub-frame time scheme, and when N=2, the brightness loss decreases down to 15% of the weighted sub-frame time scheme. The comparison of the two schemes, weighted sub-frame time with uniform illumination scheme and uniform sub-frame time with weighted illumination scheme, are described in more detail by way of the examples shown in FIGS. 9 and 10.

In the example depicted in FIG. 8, two sub-frames are utilized with 16/17 and 16/17 sub-frame time for the MSB sub-frame and LSB sub-frame respectively. The display brightness for the brightest state is 15, as shown in Equation 5.

$$\tfrac{1}{16}(\text{sub-frame time})\times 15(\text{grayscale})\times 1(\text{illumination})+\tfrac{1}{17}\times 15\times 1=15=100\% \quad (5)$$

In FIG. 9, a uniform sub-frame time with a weighted illumination scheme is illustrated. As described above, a frame can be divided up to N/2 sections where N is the total number of data bits. In order to simplify the control circuit used in weighted sub-frame scheme and reduce brightness loss, the sub-frame number is then made to be $2^N+1$, N>1. FIG. 9 illustrates an example when N=0. In this scheme, two sub-frames are utilized. The sub-frame time is ½ for each sub-frame, and the illumination is 1 and 1/16 for the MSB sub-frame and LSB sub-frame respectively. The brightness for the display to achieve a 15 grayscale is 8, which is only slightly over 53% of the brightness illustrated in FIG. 8. In other words, the display experienced almost 47% brightness decrease, as shown in Equation 6.

$$\tfrac{1}{2}(\text{sub-frame time})\times 15(\text{grayscale})\times 1(\text{illumination})+\tfrac{1}{2}\times 15\times \tfrac{1}{16}=8=53\% \quad (6)$$

In FIG. 10, another uniform sub-frame time with the weighted illumination scheme is illustrated. Once the N is fixed, the weight difference of MSB and LSB determines the illumination. In the example depicted in FIG. 10, N is set to be 2, the number of sub-frame for MSB is four and that of LSB is one. The total sub-frame number is 5, and the sub-frame time is 1/5. Since the weight difference of MSB and LSB is 16 and total frame time for MSB is four times longer than that of LSB, therefore, additional factor of four is required for illumination to accomplish 16 weight difference. That is, 4 (sub-frame time of MSB) times 1 (illumination): 1 (sub-frame time of LSB) times×(illumination)=16:1⇒×=4/16=¼. The weighted illumination is 1 for the first four sub-frames and ¼ for the last sub-frame. In this example, the smallest fraction will be ½. If the illumination of the last sub-frame is one, then this is equivalent to the weighted sub-frame time method with uniform illumination. The brightness for the display to achieve a 15 grayscale is 12.75, which is 85% of the brightness illustrated in FIG. 8. In other words, the display only experienced 15% brightness decrease, as shown in Equation 7.

$$\tfrac{4}{5}(\text{first four sub-frame time})\times 15(\text{grayscale})\times 1(\text{illumination})+\tfrac{1}{5}\times 1\times \tfrac{1}{4}=12.75=85\% \quad (7)$$

Figure 11:
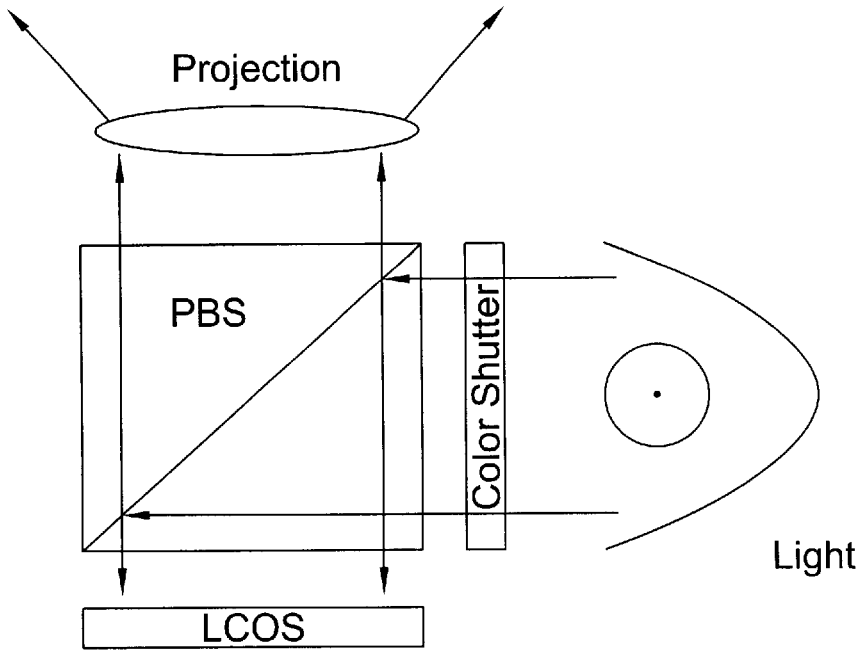
FIG. 11 shows a 1-panel projection display with field sequential color, according to an embodiment of the present invention.

FIG. 11 depicts a 1-panel projection display with field sequential color, according to another embodiment of the present invention. When a field sequential color method is used with two sub-frames (MSB and LSB), the total number of sub-frames is six, since three sub-frames are needed for red, blue, and green sub-images per image in field sequential color method and two sub-frames are required to display an image with the mixed method of the present invention.

Figure 12:
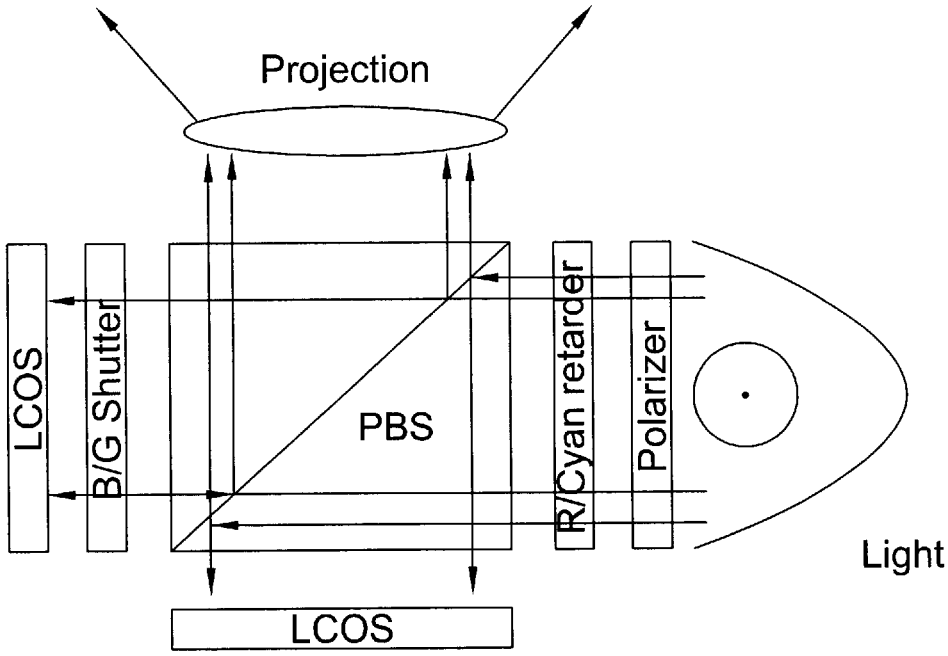
FIG. 12 shows a 2-panel projection display with partial field sequential color, according to an embodiment of the present invention.

FIG. 12 depicts a 2-panel projection display with partial field sequential color, according to another embodiment of the present invention. The mixed grayscale method can be applied analog display devices such as Liquid Crystal Displays (LCDs), Plasma Display Panels (PDPs), Field Emission Displays (FEDs). Also this method can be applied binary display devices such as Digital Mirror Displays (DMDs), and Ferroelectric Liquid Crystal Displays (FLCDs) by converting analog data to pulse width modulated data.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A method of generating a mixed grayscale representation for a display system, comprising:

(a) dividing a frame of digital display data into a plurality of sub-frames;

(b) determining illumination intensities for the plurality of sub-frames;

(c) generating analog grayscale voltages for the digital data in each of the sub-frames based on the illumination intensities; and (d) displaying an image on the display system based on the generated analog grayscale voltages, wherein the generating step includes computing a voltage difference ΔV by dividing a maximum analog pixel voltage V with a grayscale G, and generating the analog grayscale voltages from the digital data based on the voltage difference ΔV.

2. The method according to claim 1, wherein the sub-frames are greater than 1 and comparable to N (number of data bits).

3. The method according to claim 1, wherein the sub-frames are weighted or uniform.

4. The method according to claim 2, wherein the illumination intensity is weighted or uniform.

5. The method according to claim 2, wherein the N parameter is optimized for at least brightness loss of the display system.

6. The method according to claim 1, wherein the sub-frame time is uniform and the number of sub-frames is equal to $2^N+1$, wherein N>0.

7. The method according to claim 1, wherein the frame is divided into at least a sub-frame of least significant bits (LSBs) and a sub-frame of most significant bits (MSBs).

8. The method according to claim 1, wherein the mixed grayscale representation is implemented with an analog frame buffer pixel circuit.

9. The method according to claim 1, wherein the display system includes a frame buffer pixel display system.

10. The method according to claim 1, wherein the display system comprises at least one of a thin film transistor liquid crystal display (TFT LCD), a liquid crystal on silicones (LCOSs), an electro luminescence (EL) display, a plasma display panel (PDP), and a field emission display (FED).

11. The method according to claim 1, wherein the display system comprises at least one of a digital mirror display (DMD) and a ferroelectric liquid crystal display (FLCD) with an analog-to-pulse width modulation converter.

12. The method according to claim 1, further comprising:

modifying the analog grayscale voltages using gamma correction.

13. A system for generating a mixed grayscale representation, comprising:

a divider configured to divide a frame of digital display data into a plurality of sub-frames;

a first controller configured to determine illumination intensities for the plurality of sub-frames;

a voltage generator configured to generate an analog grayscale voltage for the digital data in each of the sub-frames based on the illumination intensities; and a display system configured to display an image based on the analog grayscale voltage generated for each of the sub-frames, wherein the voltage generator computes a voltage difference $\Delta V$ by dividing a maximum analog pixel voltage V with a grayscale G and generates the analog grayscale voltages from the digital data based on the voltage difference $\Delta V$.

14. The system according to claim 13, wherein the sub-frames are greater than 1 and comparable to N (number of data bits).

15. The system according to claim 14, wherein the sub-frames are weighted or uniform.

16. The system according to claim 14, wherein the illumination intensity is weighted or uniform.

17. The system of claim 13, wherein the plurality of sub-frames is equal to $2^N+1$, wherein $N>0$.

18. The system according to claim 17, wherein the N parameter is optimized for at least brightness loss of the display system.

19. The system according to claim 13, wherein the frame is divided into at least a sub-frame of least significant bits (LSBs) and a sub-frame of most significant bits (MSB).

20. The system according to claim 13, wherein the mixed grayscale representation is implemented with an analog frame buffer pixel circuit.

21. The system according to claim 13, wherein the display system comprises a frame buffer pixel display system.

22. The system according to claim 13, wherein the display system comprises at least one of a thin film transistor liquid crystal display (TFT LCD), a liquid crystal on silicones (LCOSs), an electro luminescence (EL) display, a plasma display panel (PDP) and a field emission display (FED).

23. The system according to claim 13, wherein the display system comprises at least one of a digital mirror display (DMD) and a ferroelectric liquid crystal display (FLCD) with an analog-to-pulse width modulation converter.

24. The system according to claim 13, further comprising:

a correction circuit which modifies the analog grayscale voltages using gamma correction.

* * * * *